US007926733B2

(12) United States Patent
Micheli

(10) Patent No.: US 7,926,733 B2
(45) **Date of Patent: *Apr. 19, 2011**

(54) FLUID ATOMIZING SYSTEM AND METHOD

(75) Inventor: Paul R. Micheli, Glen Ellyn, IL (US)

(73) Assignee: Illinois Tool Works Inc., Glenview, IL (US)

( * ) Notice: Subject to any disclaimer, the term of this patent is extended or adjusted under 35 U.S.C. 154(b) by 957 days.

This patent is subject to a terminal disclaimer.

(21) Appl. No.: 10/880,653

(22) Filed: Jun. 30, 2004

(65) Prior Publication Data

US 2006/0000928 A1 Jan. 5, 2006

(51) Int. Cl.
*A62C 5/02* (2006.01)

(52) U.S. Cl. ..... 239/8; 239/296; 239/298; 239/414; 239/417.5; 239/424; 239/424.5; 239/433; 239/470; 239/487; 239/500; 239/518; 239/525

(58) Field of Classification Search ..... 239/290–301, 239/461–524, 414, 417.3, 423, 424, 424.5, 239/425, 525, 526, 1, 8, 433, 537–539
See application file for complete search history.

(56) References Cited

U.S. PATENT DOCUMENTS

| | | | | |
|---|---|---|---|---|
| 1,650,128 | A | 11/1927 | Hubbard | |
| 1,741,169 | A * | 12/1929 | Thompson | 239/300 |
| 2,246,211 | A | 6/1941 | Kilich | |
| 2,303,280 | A | 11/1942 | Jenkins | 299/140.1 |
| 2,307,014 | A * | 1/1943 | Becker et. al. | 239/438 |
| 2,435,605 | A | 2/1948 | Rowell | |
| 2,595,759 | A * | 5/1952 | Buckland et. al. | 239/403 |
| 2,895,685 | A * | 7/1959 | Peeps | 239/400 |
| 2,993,655 | A | 7/1961 | Obrien | |
| 3,032,277 | A * | 5/1962 | Petty | 239/408 |
| 3,100,084 | A | 8/1963 | Biber | |
| 3,130,910 | A | 4/1964 | Sill | |
| 3,190,564 | A | 6/1965 | Liedberg | |
| 3,344,558 | A | 10/1967 | Kirkland | |
| 3,521,824 | A * | 7/1970 | Wilcox | 239/424.5 |
| 3,734,406 | A | 5/1973 | Runstadler, Jr. et al. | |

(Continued)

FOREIGN PATENT DOCUMENTS

EP 0 630 690 A 12/1994

(Continued)

OTHER PUBLICATIONS

Spanogle et al.; *Development of an Impinging-Jet Fuel-Injection Valve Nozzle*; Langley Memorial Aeronautical Laboratory, National Advisory Committee for Aeronautics; Technical Note No. 372, 1931.

*Primary Examiner* — Steven J Ganey
(74) *Attorney, Agent, or Firm* — Fletcher Yoder

(57) ABSTRACT

In accordance with certain embodiments, a spray coating device includes a body and a spray formation head coupled to the body. The spray formation head has a fluid delivery mechanism comprising a pintle, a sleeve disposed about the pintle, and a throat between the pintle and the sleeve, wherein the throat decreases in cross-section at least partially lengthwise through the fluid delivery mechanism toward a fluid exit between the pintle and the sleeve. The spray formation head also has a pneumatic atomization mechanism disposed adjacent the fluid delivery mechanism, wherein the pneumatic atomization mechanism comprises a plurality of pneumatic orifices.

29 Claims, 6 Drawing Sheets

U.S. PATENT DOCUMENTS

| | | | | | |
|---|---|---|---|---|---|
| 3,746,253 | A | | 7/1973 | Walberg | |
| 3,747,851 | A | * | 7/1973 | Conrad | 239/8 |
| 3,857,511 | A | * | 12/1974 | Govindan | 239/11 |
| 3,907,202 | A | * | 9/1975 | Binoche | 239/705 |
| 3,946,947 | A | | 3/1976 | Schneider | |
| 4,159,082 | A | | 6/1979 | Luderer et al. | 239/407 |
| 4,260,110 | A | | 4/1981 | Werding | |
| 4,330,086 | A | | 5/1982 | Nysted | |
| 4,406,407 | A | | 9/1983 | Aprea et al. | |
| 4,485,968 | A | | 12/1984 | Berthiaume | |
| 4,520,962 | A | * | 6/1985 | Momono et al. | 239/488 |
| 4,632,314 | A | | 12/1986 | Smith et al. | |
| 4,646,968 | A | | 3/1987 | Sablatura | 239/10 |
| 4,767,057 | A | | 8/1988 | Degli et al. | |
| 4,899,937 | A | | 2/1990 | Haruch | |
| 4,909,443 | A | * | 3/1990 | Takagi | 239/440 |
| 4,998,672 | A | | 3/1991 | Bordaz et al. | |
| 5,035,358 | A | | 7/1991 | Katsuno et al. | |
| 5,072,883 | A | * | 12/1991 | Vidusek | 239/290 |
| 5,074,466 | A | | 12/1991 | Santiago | |
| 5,106,025 | A | | 4/1992 | Giroux et al. | |
| 5,170,941 | A | * | 12/1992 | Morita et al. | 239/416.4 |
| 5,180,104 | A | | 1/1993 | Mallette | |
| 5,209,405 | A | | 5/1993 | Robinson et al. | 239/296 |
| 5,249,746 | A | | 10/1993 | Kaneko et al. | 239/296 |
| 5,273,059 | A | | 12/1993 | Gross et al. | 134/57 R |
| 5,319,568 | A | | 6/1994 | Bezaire | |
| 5,344,078 | A | | 9/1994 | Fritz et al. | 239/296 |
| 5,358,182 | A | | 10/1994 | Cappeau et al. | |
| 5,419,491 | A | | 5/1995 | Breitspreche | |
| 5,553,784 | A | * | 9/1996 | Theurer | 239/403 |
| 5,685,482 | A | * | 11/1997 | Sickles | 239/3 |
| 5,685,495 | A | | 11/1997 | Pham et al. | |
| 5,699,967 | A | | 12/1997 | Conatser et al. | 239/526 |
| 5,899,387 | A | * | 5/1999 | Haruch | 239/296 |
| 6,021,962 | A | | 2/2000 | Hedger | |
| 6,045,057 | A | | 4/2000 | Moor et al. | 239/9 |
| 6,085,996 | A | | 7/2000 | Culbertson et al. | 239/290 |
| 6,129,295 | A | | 10/2000 | Johansson | 239/525 |
| 6,142,388 | A | * | 11/2000 | Schwab | 239/405 |
| 6,152,388 | A | | 11/2000 | Rohloff | |
| 6,161,778 | A | | 12/2000 | Haruch | |
| 6,186,273 | B1 | | 2/2001 | Goldbach et al. | 182/128 |
| 6,189,214 | B1 | | 2/2001 | Skeath et al. | |
| 6,289,676 | B1 | | 9/2001 | Prociw et al. | |
| 6,450,422 | B1 | | 9/2002 | Maggio | 239/345 |
| 6,592,054 | B2 | | 7/2003 | Prus | |
| 6,659,367 | B2 | | 12/2003 | Ballu | |
| 6,669,115 | B2 | * | 12/2003 | Sun et al. | 239/403 |
| 6,776,360 | B2 | | 8/2004 | Haruch et al. | |
| 6,808,122 | B2 | | 10/2004 | Micheli | |
| 7,028,916 | B2 | | 4/2006 | Micheli | |
| 7,311,271 | B2 | | 12/2007 | Micheli | |
| 7,762,476 | B2 | | 7/2010 | Micheli | |
| 2002/0195505 | A1 | * | 12/2002 | Haruch et al. | 239/526 |
| 2003/0066905 | A1 | | 4/2003 | Huffman | 239/135 |
| 2006/0000928 | A1 | | 1/2006 | Micheli | |
| 2008/0048055 | A1 | | 2/2008 | Micheli | |

FOREIGN PATENT DOCUMENTS

| | | | |
|---|---|---|---|
| EP | 1 108 476 | A | 6/2001 |
| EP | 1 391 246 | A | 2/2004 |
| EP | 1611958 | | 1/2006 |
| JP | 463384 | | 10/1971 |
| JP | 51000011 | | 1/1976 |
| JP | 63319076 | | 12/1988 |
| JP | 9094494 | | 4/1999 |
| JP | 2001017893 | | 1/2001 |
| TW | 200406259 | | 5/2004 |
| TW | 200510069 | | 3/2005 |
| WO | WO9407607 | | 4/1994 |
| WO | WO0000770 | | 1/2000 |
| WO | WO0102099 | | 1/2001 |

* cited by examiner

FLUID ATOMIZING SYSTEM AND METHOD

BACKGROUND OF THE INVENTION

The present technique relates generally to spray systems and, more particularly, to industrial spray coating systems. The present technique specifically provides a system and method for improving atomization in a spray coating device by internally inducing fluid breakup.

Spray coating devices are used to apply a spray coating to a wide variety of produce types and materials, such as wood and metal. The spray coating fluids used for each different industrial application may have much different fluid characteristics and desired coating properties. For example, wood coating fluids/stains are generally viscous fluids, which may have significant particulate/ligaments throughout the fluid/stain. Existing spray coating devices, such as air atomizing spray guns, are often unable to breakup the foregoing particulate/ligaments. The resulting spray coating has an undesirably inconsistent appearance, which may be characterized by mottling and various other inconsistencies in textures, colors, and overall appearance. In air atomizing spray guns operating at relatively low air pressures, such as below 10 psi, the foregoing coating inconsistencies are particularly apparent.

Accordingly, a technique is needed for internally inducing fluid breakup to enhance subsequent atomization at a spray formation section of a spray coating device.

SUMMARY OF THE INVENTION

In accordance with certain embodiments, a spray coating device includes a body and a spray formation head coupled to the body. The spray formation head has a fluid delivery mechanism comprising a pintle, a sleeve disposed about the pintle, and a throat between the pintle and the sleeve, wherein the throat decreases in cross-section at least partially lengthwise through the fluid delivery mechanism toward a fluid exit between the pintle and the sleeve. The spray formation head also has a pneumatic atomization mechanism disposed adjacent the fluid delivery mechanism, wherein the pneumatic atomization mechanism comprises a plurality of pneumatic orifices.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

As discussed in detail below, the present technique provides a refined spray for coating and other spray applications by internally inducing breakup of fluid passing through a spray coating device. This internal breakup is achieved by passing the fluid through one or more varying geometry passages, which may comprises sharp turns, abrupt expansions or contractions, or other mixture-inducing flow paths. For example, certain embodiments of the spray coating device may have a fluid delivery tip assembly, which has a sleeve disposed about a pintle to form a converging flow path. This converging flow path extends to a spray formation exit of the spray coating device. Thus, the converging flow path accelerates the fluid flow, thereby enhancing fluid atomization at the spray formation exit. For example, the increased fluid velocity may induce vortex shedding, fluid atomization, droplet distribution and uniformity, and so forth. Moreover, some embodiments of the fluid delivery tip assembly have helical channels to induce rotation of the fluid exiting at the spray formation exit of the spray coating device. Thus, the spray exhibits a vortical motion, which further enhances the spray. For example, the pintle and/or the sleeve may have a plurality of helical channels, which can have a variety of angles, sizes, and so forth. The present technique also may optimize the foregoing fluid breakup and atomization by varying the fluid velocities, degree of convergence and rotation, and other characteristics of the spray coating device.

Figure 1:
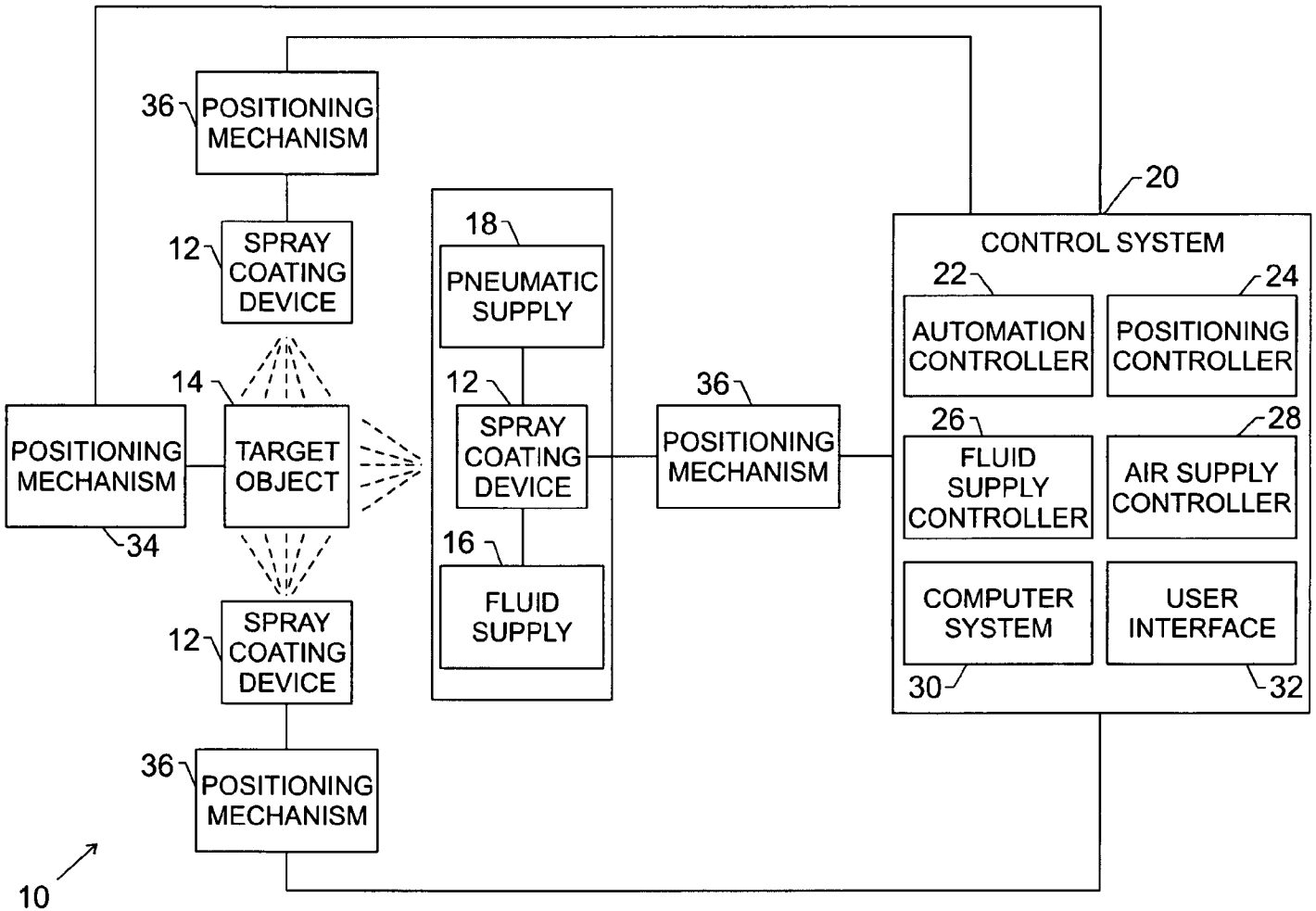
FIG. 1 is a diagram illustrating an exemplary spray coating system in accordance with certain embodiments of the present technique.

FIG. 1 is a flow chart illustrating an exemplary spray coating system 10, which comprises a spray coating device 12 for applying a desired coating to a target object 14. The illustrated spray coating device 12 may comprise an air atomizer, a rotary atomizer, an electrostatic atomizer, or any other suitable spray formation mechanism. As discussed in further detail below with reference to FIGS. 4-7, the spray coating device 12 also has a unique fluid delivery tip assembly 204 in accordance with certain embodiments of the present technique. The spray coating device 12 may be coupled to a variety of supply and control systems, such as a fluid supply 16, an air supply 18, and a control system 20. The control system 20 facilitates control of the fluid and air supplies 16 and 18 and ensures that the spray coating device 12 provides an acceptable quality spray coating on the target object 14. For example, the control system 20 may include an automation controller 22, a positioning controller 24, a fluid supply controller 26, an air supply controller 28, a computer system 30, and a user interface 32.

The control system 20 also may be coupled to one or more positioning mechanisms 34 and 36. For example, the positioning mechanism 34 facilitates movement of the target object 14 relative to the spray coating device 12. The positioning mechanism 36 is coupled to the spray coating device 12, such that the spray coating device 12 can be moved relative to the target object 14. Also, the system 10 can include a plurality of the spray coating devices 12 coupled to positioning mechanisms 36, thereby providing improved coverage of the target object 14. Accordingly, the spray coating system 10 can provide a computer-controlled mixture of coating fluid, fluid and air flow rates, and spray pattern/coverage over the target object. Depending on the particular application, the positioning mechanisms 34 and 36 may include a robotic arm, conveyor belts, and other suitable positioning mechanisms.

Figure 2:
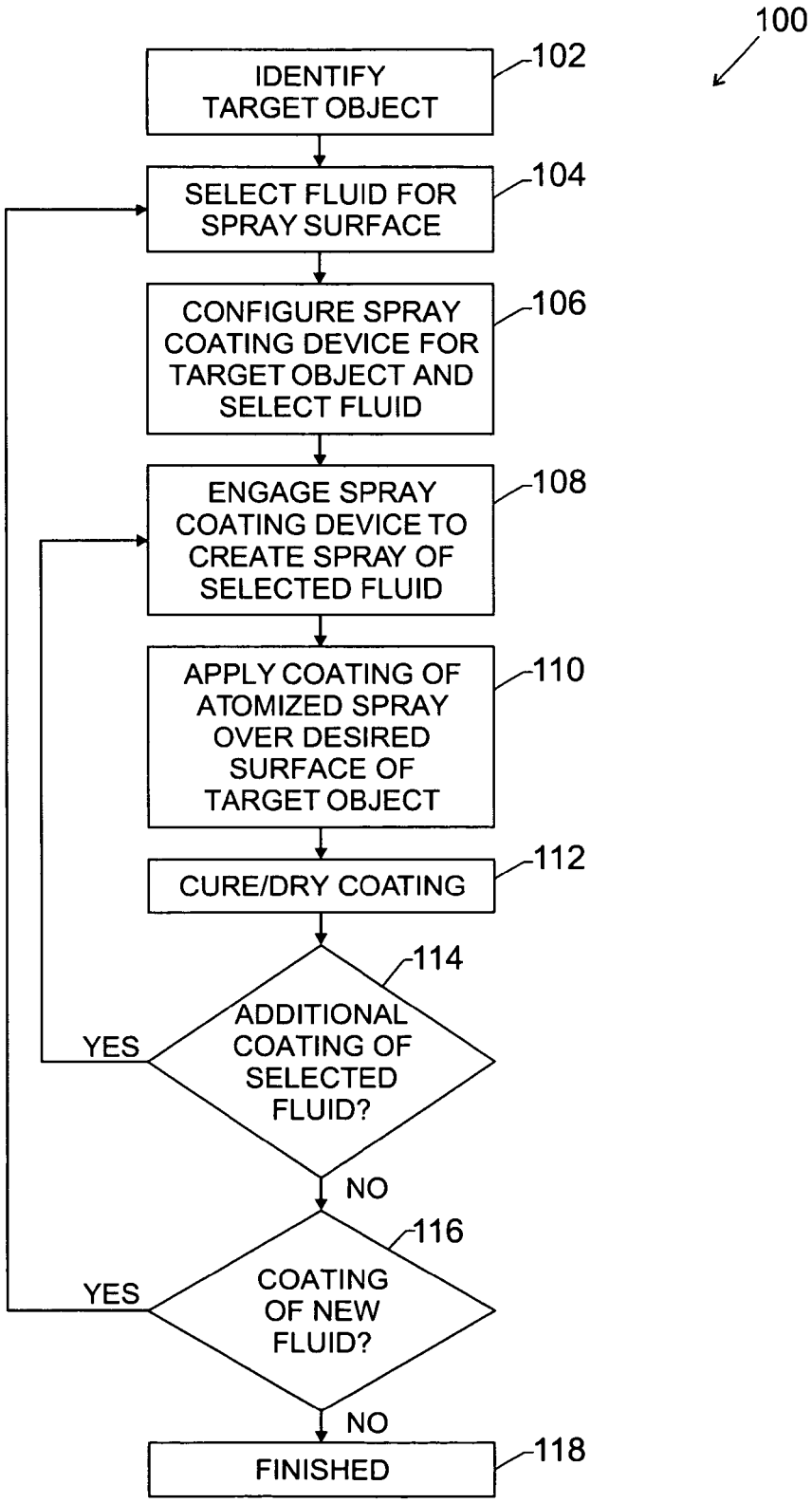
FIG. 2 is a flow chart illustrating an exemplary spray coating process in accordance with certain embodiments of the present technique.

FIG. 2 is a flow chart of an exemplary spray coating process 100 for applying a desired spray coating to the target object 14. As illustrated, the process 100 proceeds by identifying the target object 14 for application of the desired fluid (block 102). The process 100 then proceeds by selecting the desired fluid 40 for application to a spray surface of the target object 14 (block 104). A user may then proceed to configure the spray coating device 12 for the identified target object 14 and selected fluid 40 (block 106). As the user engages the spray coating device 12, the process 100 then proceeds to create an atomized spray of the selected fluid 40 (block 108). The user may then apply a coating of the atomized spray over the desired surface of the target object 14 (block 110). The process 100 then proceeds to cure/dry the coating applied over the desired surface (block 112). If an additional coating of the selected fluid 40 is desired by the user at query block 114, then the process 100 proceeds through blocks 108, 110, and 112 to provide another coating of the selected fluid 40. If the user does not desire an additional coating of the selected fluid at query block 114, then the process 100 proceeds to query block 116 to determine whether a coating of a new fluid is desired by the user. If the user desires a coating of a new fluid at query block 116, then the process 100 proceeds through blocks 104-114 using a new selected fluid for the spray coating. If the user does not desire a coating of a new fluid at query block 116, then the process 100 is finished at block 118.

Figure 3:
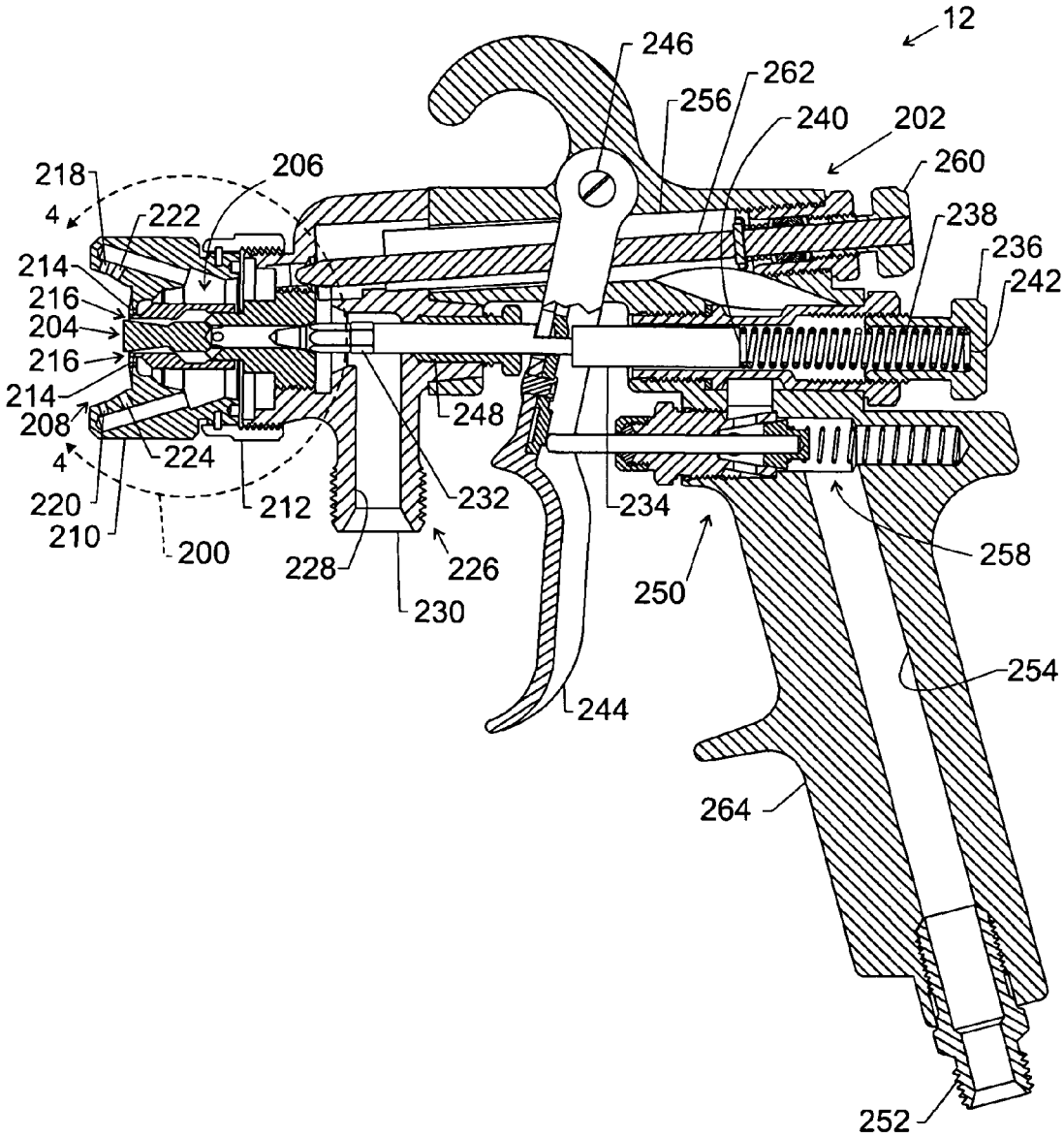
FIG. 3 is a cross-sectional side view of an exemplary spray coating device in accordance with certain embodiments of the present technique.

FIG. 3 is a cross-sectional side view illustrating an exemplary embodiment of the spray coating device 12. As illustrated, the spray coating device 12 comprises a spray tip assembly 200 coupled to a body 202. The spray tip assembly 200 includes a fluid delivery tip assembly 204, which may be removably inserted into a receptacle 206 of the body 202. For example, a plurality of different types of spray coating devices may be configured to receive and use the fluid delivery tip assembly 204. The spray tip assembly 200 also includes a spray formation assembly 208 coupled to the fluid delivery tip assembly 204. The spray formation assembly 208 may include a variety of spray formation mechanisms, such as air, rotary, and electrostatic atomization mechanisms. However, the illustrated spray formation assembly 208 comprises an air atomization cap 210, which is removably secured to the body 202 via a retaining nut 212. The air atomization cap 210 includes a variety of air atomization orifices, such as a central atomization orifice 214 disposed about a fluid tip exit 216 from the fluid delivery tip assembly 204. The air atomization cap 210 also may have one or more spray shaping orifices, such as spray shaping orifices 218, 220, 222, and 224, which force the spray to form a desired spray pattern (e.g., a flat spray). The spray formation assembly 208 also may comprise a variety of other atomization mechanisms to provide a desired spray pattern and droplet distribution.

The body 202 of the spray coating device 12 includes a variety of controls and supply mechanisms for the spray tip assembly 200. As illustrated, the body 202 includes a fluid delivery assembly 226 having a fluid passage 228 extending from a fluid inlet coupling 230 to the fluid delivery tip assembly 204. The fluid delivery assembly 226 also comprises a fluid valve assembly 232 to control fluid flow through the fluid passage 228 and to the fluid delivery tip assembly 204. The illustrated fluid valve assembly 232 has a needle valve 234 extending movably through the body 202 between the fluid delivery tip assembly 204 and a fluid valve adjuster 236. The fluid valve adjuster 236 is rotatably adjustable against a spring 238 disposed between a rear section 240 of the needle valve 234 and an internal portion 242 of the fluid valve adjuster 236. The needle valve 234 is also coupled to a trigger 244, such that the needle valve 234 may be moved inwardly away from the fluid delivery tip assembly 204 as the trigger 244 is rotated counter clockwise about a pivot joint 246. However, any suitable inwardly or outwardly openable valve assembly may be used within the scope of the present technique. The fluid valve assembly 232 also may include a variety of packing and seal assemblies, such as packing assembly 248, disposed between the needle valve 234 and the body 202.

An air supply assembly 250 is also disposed in the body 202 to facilitate atomization at the spray formation assembly 208. The illustrated air supply assembly 250 extends from an air inlet coupling 252 to the air atomization cap 210 via air passages 254 and 256. The air supply assembly 250 also includes a variety of seal assemblies, air valve assemblies, and air valve adjusters to maintain and regulate the air pressure and flow through the spray coating device 12. For example, the illustrated air supply assembly 250 includes an air valve assembly 258 coupled to the trigger 244, such that rotation of the trigger 244 about the pivot joint 246 opens the air valve assembly 258 to allow air flow from the air passage 254 to the air passage 256. The air supply assembly 250 also includes an air valve adjustor 260 coupled to a needle 262, such that the needle 262 is movable via rotation of the air valve adjustor 260 to regulate the air flow to the air atomization cap 210. As illustrated, the trigger 244 is coupled to both the fluid valve assembly 232 and the air valve assembly 258, such that fluid and air simultaneously flow to the spray tip assembly 200 as the trigger 244 is pulled toward a handle 264 of the body 202. Once engaged, the spray coating device 12 produces an atomized spray with a desired spray pattern and droplet distribution. Again, the illustrated spray coating device 12 is only an exemplary device of the present technique. Any suitable type or configuration of a spraying device may benefit from the unique fluid mixing, particulate breakup, and refined atomization aspects of the present technique.

Figure 4:
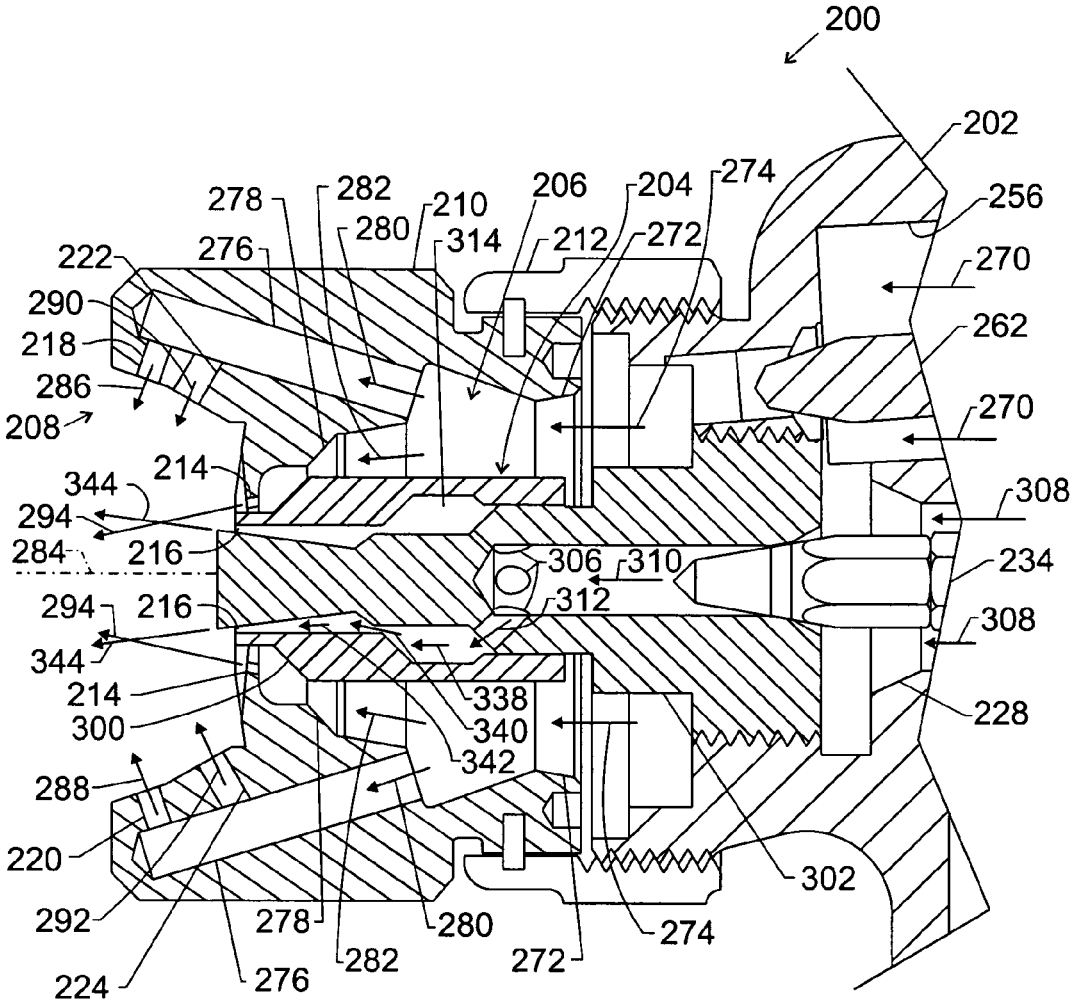
FIG. 4 is a partial cross-sectional view of an exemplary spray tip assembly of the spray coating device of FIG. 3 in accordance with certain embodiments of the present technique.

FIG. 4 is a partial cross-sectional view of the spray tip assembly 200 of the spray coating device 12 of FIG. 3 in accordance with certain embodiments of the present technique. As illustrated, the needle 262 of the air supply assembly 250 and the needle valve 234 of the fluid valve assembly 232 are both open, such that air and fluid passes through the spray tip assembly 200 as indicated by the arrows. Turning first to the air supply assembly 250, the air flows through air passage 256 about the needle 262 as indicated by arrow 270. The air then flows from the body 202 and into a central air passage 272 in the air atomization cap 210, as indicated by arrows 274. The central air passage 272 then splits into outer and inner air passages 276 and 278, such that the air flows as indicated by arrows 280 and 282, respectively. The outer passages 276 then connect with the spray shaping orifices 218, 220, 222, and 224, such that the air flows inwardly toward a longitudinal axis 284 of the spray tip assembly 200. These spray shaping airflows are illustrated by arrows 286, 288, 290, and 292. The inner passages 278 surround the fluid delivery tip assembly 204 and extend to the central atomization orifices 214, which are positioned adjacent the fluid tip exit 216 of the fluid delivery tip assembly 204. These central atomization orifices 214 eject air atomizing flows inwardly toward the longitudinal axis 284, as indicated by arrows 294. These air flows 286, 288, 290, 292, and 294 are all directed toward a fluid flow 296 ejected from the fluid tip exit 216 of the fluid delivery tip assembly 204. In operation, these air flows 286, 288, 290, 292, and 294 facilitate fluid atomization to form a spray and, also, shape the spray into a desired pattern (e.g., flat, rectangular, oval, etc.).

Figure 5:
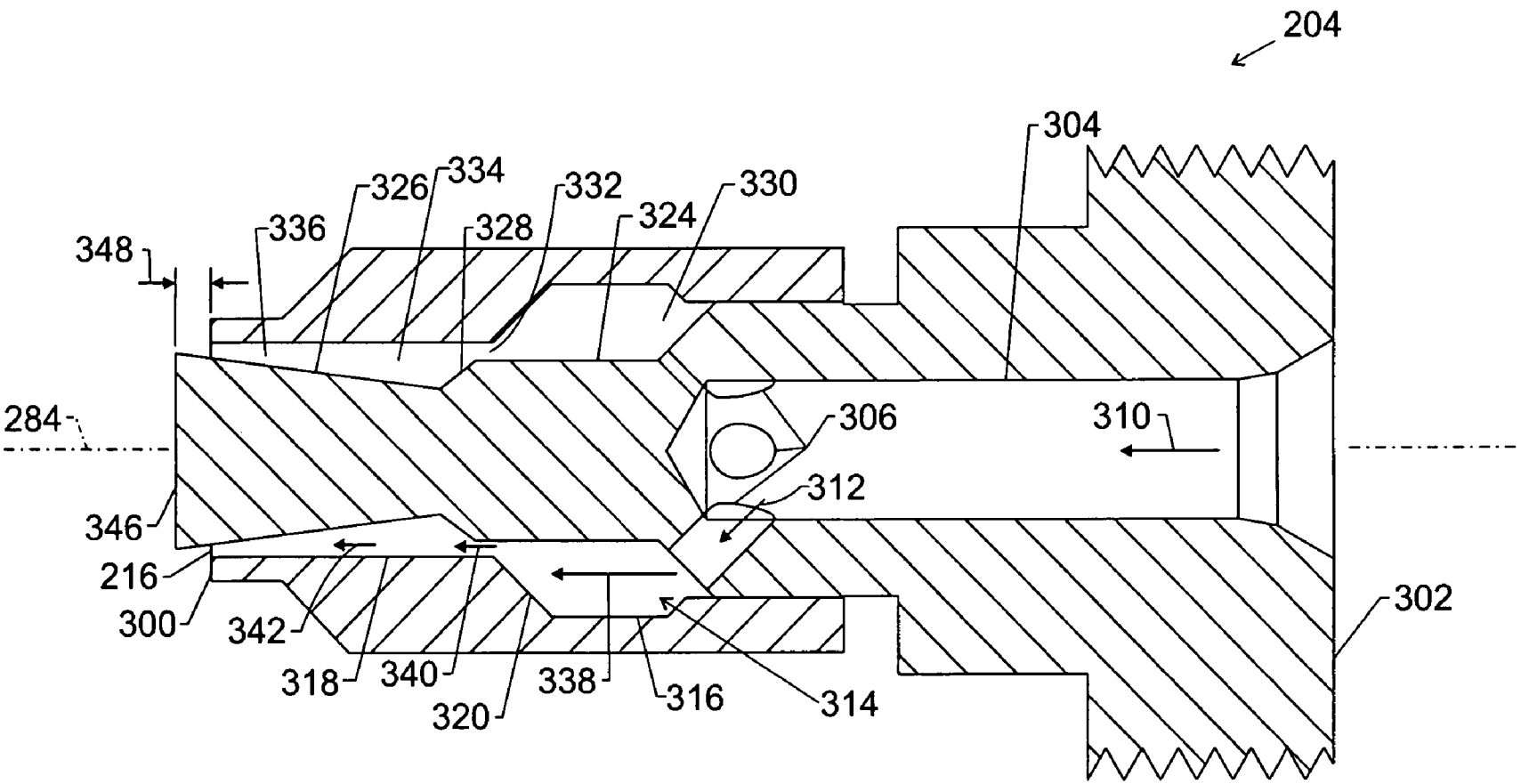
FIG. 5 is a cross-sectional view of an exemplary fluid delivery tip assembly of the spray tip assembly of FIG. 4 in accordance with certain embodiments of the present technique.

Turning to the fluid flow in the spray tip assembly 200, the fluid delivery tip assembly 204 includes an annular casing or sleeve 300 disposed about central member or pintle 302, as illustrated by FIGS. 4 and 5. The illustrated pintle 302 includes a central fluid passage or preliminary chamber 304, which leads to one or more restricted passageways or supply holes 306. These supply holes 306 can have a variety of geometries, angles, numbers, and configurations (e.g., symmetrical or non-symmetrical) to adjust the velocity, direction, and flow rate of the fluid flowing through the fluid delivery tip assembly 204. For example, in certain embodiments, the pintle 302 may include six supply holes 306 disposed symmetrically about the longitudinal axis 284 of the spray tip assembly 200. In operation, when the need valve 234 is open, a desired fluid (e.g., paint) flows through fluid passage 228 about the needle valve 234 of the fluid valve assembly 232, as indicated by arrows 308. The fluid then flows into the central fluid passage or preliminary chamber 304 of the pintle 302, as indicated by arrow 310. As indicated by arrow 312, the supply holes 306 then direct the fluid flow from the preliminary chamber 304 into a secondary chamber or throat 314.

The illustrated throat 314 of FIGS. 4 and 5 is disposed between the sleeve 300 and the pintle 302. In the illustrated embodiment, the geometry of the throat 314 substantially diverges and converges toward the fluid tip exit 216 of the fluid delivery tip assembly 204. In operation, these diverging and converging flow pathways induce fluid mixing and breakup prior to primary air atomization by the air orifices 214, 218, 220, 222, and 224 of the air atomization cap 210. For example, successive diverging and converging flow passages can induce velocity changes in the fluid flow, thereby inducing fluid mixing, turbulence, and breakup of particulate in the fluid.

In the illustrated embodiment of FIGS. 4 and 5, the diverging and converging geometries of the throat 314 are defined by the pintle 302 and by the sleeve 300. The illustrated sleeve 300 defines the outer boundaries of the throat 314. For example, the illustrated sleeve 300 includes a first annular interior 316, a second annular interior 318, and a converging interior 320 that is angled inwardly from the first annular interior 316 to the second annular interior 318. Thus, the first annular interior 316 has a relatively larger diameter than the second annular interior 318. In alternative embodiments, one or more of the sleeve interiors 316, 318, and 320 may have a non-circular geometry (e.g., square, polygonal, etc.). Furthermore, some embodiments of the sleeve interiors 316, 318, and 320 may have a non-annular geometry, such as a plurality of separate passages rather than a single annular geometry.

The illustrated pintle 302 defines the inner boundaries of the throat 314. As illustrated, a forward portion or tip section 322 of the pintle 302 includes an annular section 324, a diverging annular section or conic tip portion 326, and a converging annular section 328 extending from the annular section 324 280 to the conic tip portion 326. In other words, with reference to the longitudinal axis 284, the annular section 324 has a substantially constant diameter, the conic tip portion 326 is angled outwardly from the longitudinal axis 284 toward the fluid tip exit 216, and the converging annular section 328 is angled inwardly from the annular section 324 to the tonic tip portion 326. Again, other embodiments of the tip section 322 of the pintle 302 can have a variety of constant, inwardly angled, or outwardly angled sections, which define the inner boundaries of the throat 314.

As assembled in FIGS. 4 and 5, the sleeve 300 and pintle 302 have the sleeve interiors 316, the 320, and 318 surrounding the pintle sections 324, 328, and 326, thereby defining an annular passage 330, substantially restricted/unrestricted passages 332 and 334, and a progressively converging annular passage 336, respectively. In other words, the annular passage 330 has a relatively constant flow area, which in certain embodiments may be relatively larger than a flow area of the preliminary chamber 304. In turn, the restricted passage 332 abruptly converges or decreases the flow area where the leading end of the pintle section 328 meets the trailing end of the sleeve interior 320. Next, the pintle section 328 expands or increases the flow area relative to the sleeve interior 318. Finally the pintle section 326 contracts or decreases the flow area relative to the sleeve interior 318. As a benefit of these increasing and decreasing flow areas, the fluid delivery tip assembly 204 causes decreases and increases in the fluid flow velocity and, also, abrupt and gradual changes in fluid flow directions. Therefore, the fluid delivery tip assembly 214 enhances fluid mixing and fluid breakup (e.g., more viscous fluids or particulate), and may induce turbulent flow.

Regarding the fluid flow through the throat 314, the illustrated arrows 338, 340, and 342 indicate fluid flow pathways through the annular passage 330, through the substantially restricted/unrestricted passages 332 and 334, and through the progressively converging annular passage 336, respectively. At the fluid tip exit 216, the fluid flows out to form a sheet or cone of fluid as indicated by arrow 344. Simultaneously, the air flows 286, 288, 290, 292, and 294 from the air cap 210 coincide with the fluid sheet or cone 344, thereby atomizing the fluid and shaping a desired formation of the spray. In addition, as illustrated in FIG. 5, a tip 346 of the pintle 302 extends beyond the fluid tip exit 216 by a distance 348, which advantageously induces vortex shedding to further enhance the fluid breakup and atomization. Moreover, at the fluid tip exit 216, the increased fluid velocity attributed to the progressively converging annular passage 336 of the throat 314 further increases the velocity differential between the exiting fluid 344 and the environmental air. This increased velocity further enhances the vortex shedding and, also, substantially reduces back flow into the fluid delivery tip assembly 204.

Figure 6:
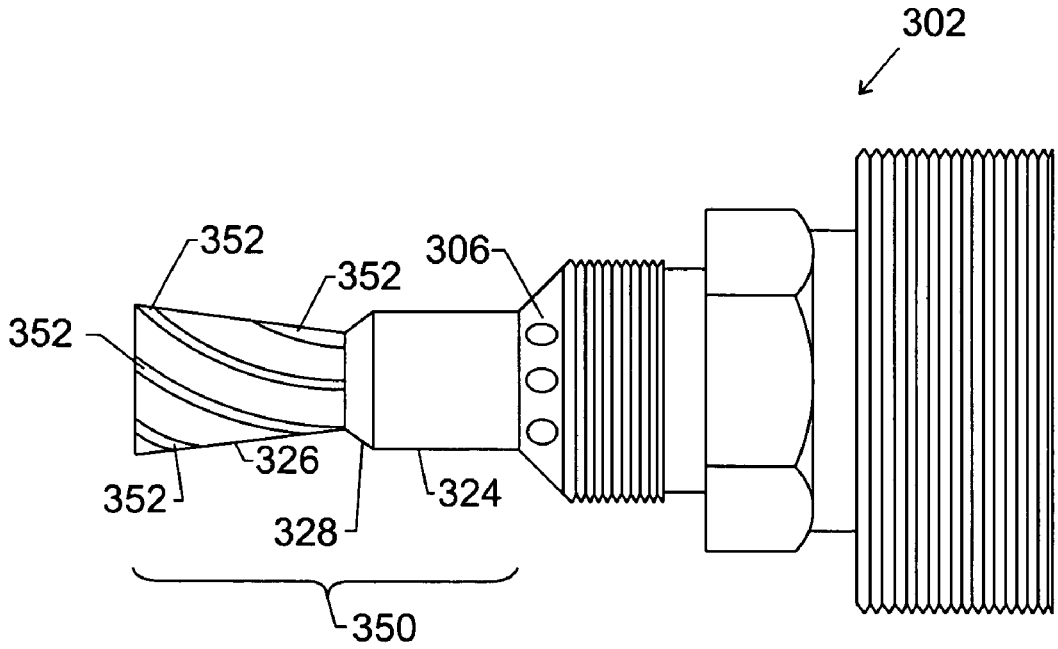
FIG. 6 is a cross-sectional view of an alternative pintle of the fluid delivery tip assembly of FIG. 5 having a plurality of helical fluid channels in accordance with certain embodiments of the present technique.
Figure 7:
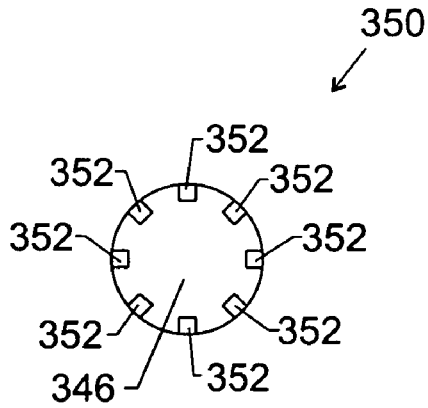
FIG. 7 is a front view of the alternative pintle of FIG. 6 in accordance with certain embodiments of the present technique.

FIGS. 6 and 7 illustrate the pintle 302 having an alternative tip section 350 in accordance with certain embodiments of the present technique. Turning first to FIG. 6, a cross-sectional view of the pintle 302 illustrates the alternative tip section 350 having a plurality of helical fluid channels 352 in accordance with certain embodiments of the present technique. As illustrated, the helical fluid channels 352 are disposed about the conic tip section 326. In operation, these helical fluid channels 352 induce rotational motion or vortical fluid flow of the converging/accelerating fluid flow passing through the converging annular passage 336. When the fluid delivery tip assembly 204 ejects this fluid at the fluid tip exit 216 (see FIGS. 4 and 5), these helical fluid channels 352 cause the spray to exhibit rotation or vortical motion, thereby enhancing fluid atomization, mixing, and droplet distribution and uniformity. These helical fluid channels 352 may have any suitable angle, geometry, configuration, and orientation within the scope of the present technique. For example, some embodiments of the helical fluid channels 352 may include four, six, eight, or ten symmetrical channels, which may have an angle of 15, 30, 45, or 60 degrees. FIG. 7 is a front view of one embodiment of the pintle section 350 of FIG. 6 having eight of the helical fluid channels 352, wherein the channels 352 have a rectangular cross-section. In addition, certain embodiments of the helical fluid channels may extend along the other sections 324 and 328 of the pintle tip section 350.

Moreover, alternative embodiments can have helical channels disposed on one or more of the sleeve interiors 316, 318, and 320.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A spray coating device, comprising:

a body;

a spray formation head coupled to the body, wherein the spray formation head comprises:

a fluid delivery mechanism comprising a pintle, a sleeve disposed about the pintle, and a throat between the pintle and the sleeve, wherein the throat decreases in cross-section at least partially lengthwise through the fluid delivery mechanism toward a fluid exit between the pintle and the sleeve, wherein the pintle comprises a central passage and at least one angled passage leading from the central passage to the throat;

a pneumatic atomization mechanism disposed adjacent the fluid delivery mechanism, wherein the pneumatic atomization mechanism comprises a plurality of pneumatic orifices.

2. The spray coating device of claim 1, wherein the throat comprises a plurality of passages that alternatingly increase and decrease in cross-sectional area lengthwise through the fluid delivery mechanism toward the fluid exit between the pintle and the sleeve.

3. The spray coating device of claim 1, comprising a valve member that opens and closes against a leading end of the central passage.

4. The spray coating device of claim 1, wherein the fluid exit comprises an annular opening adapted to form an annular sheet of fluid.

5. The spray coating device of claim 1, wherein the throat comprises a plurality of helical channels.

6. The spray coating device of claim 5, wherein the plurality of helical channels are disposed on the pintle.

7. The spray coating device of claim 1, wherein the fluid delivery mechanism comprises a valve separate from the pintle.

8. The spray coating device of claim 1, wherein the throat comprises a ring-shaped cross section that alternatingly increases and decreases in a generally linear manner with respect to a longitudinal axis of the throat.

9. A spray coating system, comprising:

a spray gun, comprising:

a body having a liquid valve;

a head coupled to the body, wherein the head comprises a liquid delivery mechanism downstream of the liquid valve, the liquid valve is configured to open and close against a portion of the liquid delivery mechanism, the liquid delivery mechanism comprises a generally annular throat having a progressively converging annular passage that leads to an annular liquid exit, the generally annular throat comprises an outer structure disposed about an inner structure, and the inner structure has at least one conic outer surface that increases in cross-section lengthwise along the liquid delivery mechanism toward the annular liquid exit.

10. The spray coating system of claim 9, wherein the head comprises an air atomization cap disposed about the liquid delivery mechanism.

11. The spray coating system of claim 9, wherein the outer structure has an inner surface that decreases in cross-section adjacent the conic outer surface of the inner structure.

12. The spray coating system of claim 9, wherein the inner structure extends beyond the annular liquid exit between the inner and outer structures.

13. The spray coating system of claim 9, wherein at least one of the inner and outer structures comprises a plurality of helical channels extending at least partially lengthwise along the generally annular throat.

14. The spray coating system of claim 9, comprising a positioning mechanism coupled to the spray gun.

15. The spray coating system of claim 14, comprising a control system coupled to the positioning mechanism.

16. The spray coating system of claim 15, comprising a plurality of spray coating devices, including the spray gun, each being coupled to the control system.

17. A coating formed by the spray coating system of claim 9.

18. A method of manufacturing a spray coating device, comprising:

providing a liquid delivery mechanism adapted to mount within a spray formation head of the spray coating device, wherein the liquid delivery mechanism comprises a throat having a plurality of successive annular passages leading toward a liquid exit of the spray formation head, the throat comprises one or more generally spiral-shaped passages disposed within at least one of the plurality of successive annular passages, the plurality of successive annular passages include cross-sections that alternatingly increase and decrease along the length of the throat, the one or more generally spiral-shaped passages extend at an angle from a central axis of the throat, and the angle is oriented radially toward or away from the central axis.

19. The method of claim 18, wherein providing the liquid delivery mechanism comprises assembling a sleeve about a pintle.

20. The method of claim 18, wherein providing the liquid delivery mechanism comprises providing a pintle at least partially within the throat, the pintle having a central passage, an angled passage from the central passage to an outer annular surface within the throat, and a conic outer surface within the throat adjacent the outer annular surface.

21. The method of claim 20, comprising providing a liquid valve that is openable and closable against a leading end of the central passage.

22. The method of claim 18, wherein providing the liquid delivery mechanism comprises providing a sleeve at least partially surrounding the throat, the sleeve having a first annular interior, a second annular interior, and a conic interior from the first annular interior to the second annular interior.

23. The method of claim 18, wherein providing the liquid delivery mechanism comprises retrofitting the liquid delivery mechanism into a spray device.

24. The method of claim 18, wherein the angle is oriented radially away from the central axis in a downstream direction toward the liquid exit of the spray formation head.

25. The method of claim 18, wherein the angle is between approximately 15 to 30 degrees relative to the central axis.

26. The method of claim 18, wherein the one or more generally spiral-shaped passages each have a curved path about the central axis of the throat.

27. A spray coating system, comprising:

a spray gun, comprising:

a body having a liquid valve; and a head coupled to the body, wherein the head comprises a liquid delivery mechanism downstream of the liquid valve, the head comprises an air atomization cap disposed about the liquid delivery mechanism, the liquid delivery mechanism comprises a generally annular throat having a progressively converging annular passage that leads to an annular liquid exit, the generally annular throat comprises an outer structure disposed about an inner structure, and the inner structure has at least one conic outer surface that increases in cross-section lengthwise along the liquid delivery mechanism toward the annular liquid exit.

28. A spray coating system, comprising:

a spray gun, comprising:

a body having a liquid valve; and a head coupled to the body, wherein the head comprises a liquid delivery mechanism downstream of the liquid valve, the liquid delivery mechanism comprises a generally annular throat having a progressively converging annular passage that leads to an annular liquid exit, the generally annular throat comprises an outer structure disposed about an inner structure, the inner structure has at least one conic outer surface that increases in cross-section lengthwise along the liquid delivery mechanism toward the annular liquid exit, and at least one of the inner and outer structures comprises a plurality of helical channels extending at least partially lengthwise along the generally annular throat.

29. A spray coating system, comprising:

a spray gun, comprising:

a body having a liquid valve; and a head coupled to the body, wherein the head comprises a liquid delivery mechanism downstream of the liquid valve, the liquid delivery mechanism comprises a generally annular throat having a progressively converging annular passage that leads to an annular liquid exit, the generally annular throat comprises an outer structure disposed about an inner structure, and the inner structure has at least one conic outer surface that increases in cross-section lengthwise along the liquid delivery mechanism toward the annular liquid exit; and a positioning mechanism coupled to the spray gun.

* * * * *